US005454680A

United States Patent [19]

Lazar

[11] Patent Number: 5,454,680

[45] Date of Patent: Oct. 3, 1995

[54] BINDING APPARATUS

[76] Inventor: Peter Lazar, Tannenstrasse 11, D-4040 Neuss 21, Germany

[21] Appl. No.: 930,663

[22] PCT Filed: Sep. 11, 1990

[86] PCT No.: PCT/EP90/01531

§ 371 Date: May 13, 1993

§ 102(e) Date: May 13, 1993

[87] PCT Pub. No.: WO91/04158

PCT Pub. Date: Apr. 4, 1991

[30] Foreign Application Priority Data

Sep. 14, 1989 [DE] Germany ..... 39 30 719.0

[51] Int. Cl.[6] ..... B42B 9/00

[52] U.S. Cl. ..... 412/11; 412/37

[58] Field of Search ..... 412/9, 11, 12, 412/13, 14, 18, 22, 33, 37, 41, 902

[56] References Cited

U.S. PATENT DOCUMENTS

| | | | |
|---|---|---|---|
| 2,549,890 | 4/1951 | Burls | 11/3 |
| 3,093,396 | 6/1963 | Segreto | 281/21 |
| 3,146,473 | 9/1964 | Hoff | 11/1 |
| 3,708,813 | 1/1973 | Carter et al. | 11/3 |
| 3,717,366 | 2/1973 | Decker | 281/21 R |
| 3,756,625 | 9/1973 | Abilgaard et al. | 412/902 X |
| 3,788,921 | 1/1974 | Polit et al. | 156/216 |
| 4,009,498 | 3/1977 | Staats et al. | 11/1 AD |
| 4,077,078 | 3/1978 | Snellman et al. | 11/1 AD |
| 4,111,100 | 2/1979 | Domroe | 412/902 X |
| 4,149,289 | 4/1979 | Sahlin | 11/1 AD |
| 4,367,116 | 1/1983 | Wiholm | 156/366 |
| 4,416,722 | 11/1983 | Bergman et al. | 156/578 |
| 4,526,642 | 7/1985 | Caughey | 412/902 X |
| 4,540,458 | 9/1985 | Baughman | 156/312 |
| 4,565,477 | 1/1986 | Axelrod | 412/5 |
| 4,626,156 | 12/1986 | Baughman et al. | 412/33 |
| 5,102,277 | 4/1992 | Tholerus | 412/8 |
| 5,152,654 | 10/1992 | Luhman et al. | 412/902 X |

FOREIGN PATENT DOCUMENTS 0491825 7/1992 European Pat. Off. .

*Primary Examiner*—Willmon Fridie
*Attorney, Agent, or Firm*—Joseph W. Berenato, III

[57] ABSTRACT

The invention concerns a binding apparatus to bind loose sheets in covers of which the spines are provided on their insides with a thermoplastic adhesive in order to form volumes, said apparatus comprising a frame with two mutually adjustably spaced rest walls forming an insertion shaft for the covers, said insertion shaft being provided at the bottom with a heating and with a cooling system. To be able to process substantial quantities of volumes to be bound, the insertion shaft 11 is extended at least on one side and the cooling system 20 is received in this extension and a conveyor assembly 27 with revolving drive 30 is provided to move the covers 9 placed into the insertion shaft 11 from the heating system 19 to the cooling system 20.

24 Claims, 1 Drawing Sheet

BINDING APPARATUS

The invention concerns a binding apparatus for binding loose sheets into covers provided inside at their spines with a thermoplastic adhesive to form a volume and comprising a frame with two mutually and adjustably spaced supports acting as an insertion shaft for the covers, said shaft being fitted at its lower side with a heater, and further comprising a cooling system.

Such binding apparatus illustratively is described in the German patent 35 14 222: it comprises a frame with an insertion shaft formed by two mutually parallel, vertical walls acting as supports. One rest wall is stationary relative to the frame, whereas the other rest wall rests in displaceable manner relative to-and-fro the stationary one. In this manner the spacing between the two rest walls can be adjusted while they remain mutually parallel.

Underneath the insertion region of the rest walls, the insertion shaft is bounded by a heater in the form of a heating plate. This heating plate consists of a top-side, horizontal deposition surface and of an electrical heating unit making it possible to raise the deposition surface to temperatures of up to 200° C. for instance.

When binding, first a stack of paper or plastic sheets is formed and then placed into one set of covers. Such covers consist of a spine with the side covers proper joined to it by a fold and further of a strip of hot-melt adhesive deposited on the inside of the spine. When binding, the covers together with the sheets laid into them are placed in the insertion shaft in such a way that the outside of the spine comes to rest on the heating plate. Next the displaceable rest wall is moved toward the stationary rest wall in order that the covers retain their vertical position during binding. Thereupon the heating plate is powered electrically to a temperature higher than the melting point of the hot-melt adhesive strip. This strip then softens and as a result the sheets laid into the covers sink by their lower edges into the hot-melt strip and are wetted by it.

After some time, the displaceable rest wall is moved back to remove the volume consisting of the covers and sheets from the binding apparatus. The volume is then deposited, spine at the bottom, on a deposition surface formed into the apparatus frame and serving as a cooling system to allow the volume to cool. Thereby the hot-melt adhesive strip again solidifies and firm bonding of the sheets into the covers has then been achieved.

The known binding apparatus are designed for office use. Where a substantial number of volumes must be bound, the known office binding apparatus are rejected in large part because they incur the operational drawback that following binding, the volume must be removed from the binding apparatus and be transported by means of a corresponding deposition surface to a cooling system.

Therefore it is the object of the invention to create a binding apparatus designed for making substantial quantities of volumes and in particular not requiring removing the volumes from this apparatus for purposes of cooling.

This problem is solved by the invention in that the insertion shaft is extended at least on one side and in that the cooling system is received in tints extension further in that a conveyor with a revolving drive is provided to carry the covers put into the insertion shaft from the heater to the cooling system.

Accordingly, in the invention, the binding apparatus comprises an enlarged insertion shaft with cascaded heater and cooling system, whereby following being heated in the heating system, the volumes no longer require being removed from the insertion shaft for the subsequent cooling stage. A conveyor with revolving drive is provided for the advance between the heating and the cooling systems, and therefore the volume is moved mechanically. Moreover the feasibility is provided thereby to simultaneously bind two sets of volumes inside the binding apparatus, one set always being in the zone of the heating system and the other set in the zone of the cooling system. The binding apparatus of the invention is suitable for processing large quantities of sheets to be bound at low operator cost because there are no transport problems and few difficulties relating to capacity between the heating and cooling systems.

In its simplest form the cooling system is a cooling plate. This cooling plate may be designed as a shake system with a vibration unit. Alternatively a shake plate with shake system may be additionally present between the heating and cooling systems. This offers the advantage that at least three sets of volumes fit into the binding apparatus of the invention, and in the case of continuous operations, one set shall be located in the heating system, one set on the shake plate and one set in the cooling system.

The shake system may be equipped with a vibration system such as are used in other fields of application. However it is possible also to design the shake system as a pivoting system to pivot the shake plate about an axis parallel to the direction of advance. Such shake systems are known from U.S. Pat. No. 4,108,713 (FIG. 3) and serve to better bind the sheets into the previously plasticized strip of hot-melt adhesive.

To accelerate cooling, the cooling system may include appropriate accessories. In particular a cooling blower supplying air to the spine of the covers is applicable. Especially advantageously, the cooling plate forming the entire cooling system shall be perforated to blow cooling air upward.

The heating system can be designed in known manner as a heating plate with a heater element. However, considering the special design of the binding apparatus of the invention, infrared radiators also may be used, or any other kind of heating system ensuring that the adhesive shall plasticize.

The conveyor can be designed in a number of ways. For instance the conveyor can be a belt moving over the heating and cooling systems. In that case the conveyor belt must consist of a heat-resistant material, for instance teflon or a metal, and to improve heat transfer, it shall be as thin as possible. Moreover line conveyor belt also may comprise perforations, and as regards link-belts, the most diverse designs are feasible as applying for instance to transport purposes. The conveyor should rest inside the insertion shaft on a continuous support surface which again may be perforated. Conceivably too, the conveyor may be self-supporting and be guided only at the edges.

As an alternative, the conveyor assembly may consist of two parallel, revolving edge belts with affixed drive means for the covers, a continuous support surface then preferably being present in the insertion shaft. The support surface may be composed of a heating plate, where called for a shake plate and a cooling plate. In that case the covers together with their spines can be made to directly advance on these plates with which they then are in immediate contact.

The conveyor assembly may be driven in such a way that once the binding apparatus has been turned ON, the conveyor revolves constantly at a speed which must be such that a set of sheet-equipped covers to be bound must be exposed a sufficiently long time to the heating system after it was placed into the insertion shaft.

As an alternative, however, a control unit together with a related switching timer may be provided to control the power to the conveyor revolving drive, said switching timer turning the revolving drive ON once the inserted covers have been exposed a specified time to the heating system, namely until the covers reach the cooling system zone and possibly the vicinity of any shake plate. In such discontinuous operation the inserted covers remain long enough in the heating system to achieve plasticization of the strip of hot-melt adhesive, whereupon they shall be moved toward the cooling system. A more compact design is made possible thereby because the heating system need only be of a length equal to that of the spine of conventional covers. In addition, the control unit may comprise such switching gear that the heating system shall be turned OFF when the revolving drive is turned ON or that the power shall be reduced to conserve energy. In that case the heating system can be turned ON again by actuating a pushbutton when inserting further covers. A more convenient solution is to provide the control unit additionally with a sensor to detect the presence of the cover in the vicinity of the heating system, said sensor then turning ON the heating system, or raising it to full power, when a cover is inserted.

For improved control of the heating system, a temperature sensor preferably is provided to detect the heating system temperature and is so connected by an electric circuit with the switching timer that latter shall be turned ON only when the heating system evinces a specified temperature. Such control is known from German patent 35 14 201 and was found quite practical.

The invention furthermore proposes equipping the control unit with a sensor to detect the presence of the covers in the vicinity of the cooling system and locking the revolving drive as long as the there are covers in the last segments of this cooling system. The purpose is to prevent covers from dropping out of the binding apparatus in the event a corresponding stacking device does not follow said shaft. In order not to expose the covers inserted into the heating system to excessively long heating, the control unit preferably shall also include an alarm that is actuated when the covers have been a specified time in the last section of the cooling system. This goal also may achieved by coupling in such a way with the switching timer controlling the heating system that upon termination of a heating cycle, the alarm is actuated and/or the heating system is turned OFF or its power is reduced.

The invention also provides that where called for the control unit shall turn ON the cooling blower and/or the shake system as soon as the sensor detects a pair of covers. In this manner the cooling blower or the shake device will not keep running unloaded.

Advantageously moreover the heating system, the cooling system and any shake plate comprise separate supports with drives for independent changes in spacing, a spacing-control being provided which so controls the drives that when starting the revolving drive the spacing between the supports as seen in the direction of advance is matched to that spacing assumed by the immediately preceding support. In this manner sets of volumes of different thicknesses can be processed while immediately following one another because the insertion shaft automatically matches the width of the set as seen in the direction of advance. Reliable support of the sets is also achieved in these cases.

In a further feature of the invention, the insertion shaft and the conveyor assembly are extended at the free side of the heating system and/or the cooling system. In this manner the covers also may be inserted ahead of the heating system into the binding apparatus or may be moved to storage sites after cooling. Advantageously a stacking device is mounted following the cooling system.

The invention is elucidated by illustrative embodiment modes described below and in relation to the drawing.

Figure 1:
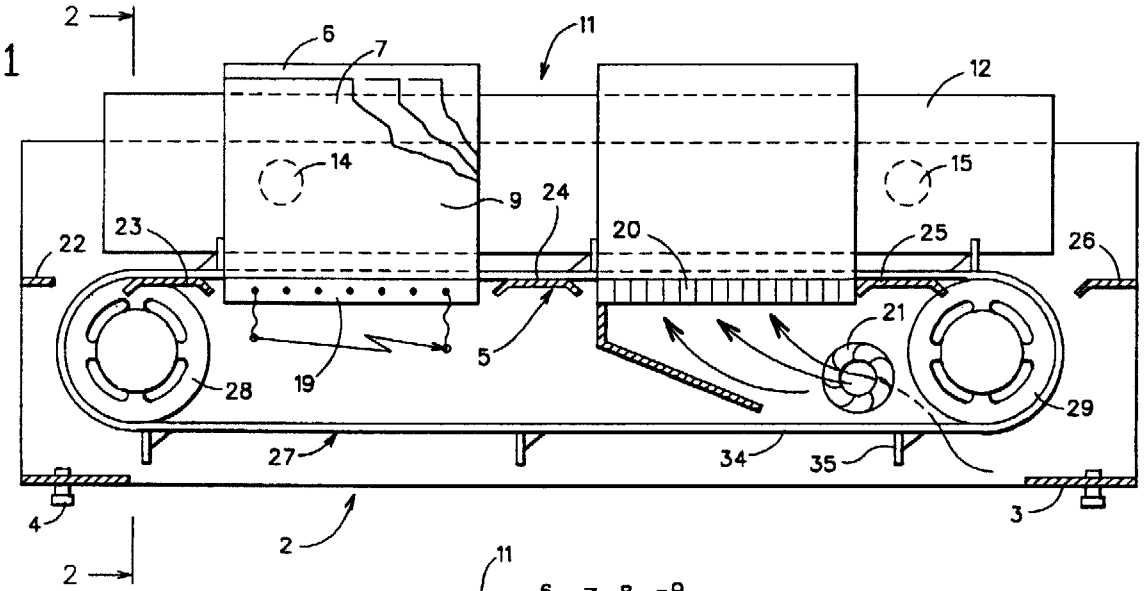
FIG. 1 is a longitudinal section of the binding apparatus.

The binding apparatus 2 shown in the Figures comprise a U-frame 3 resting by feet illustratively denoted by 4 on the ground. A conveyor track 5 is present centrally and serves to move sets 6 consisting of several volumes 7.

Each volume 7 consists of a plurality of loose sheets 8 inserted into covers 9. Each cover 9 rests on its spine 10 provided on its inside with a strip of hot-melt adhesive. The volumes 7 are placed in an insertion shaft 11 bounded by two mutually parallel, vertical rest walls 12, 13 extending in the direction of advance. The rest walls 12, 13 are located above the conveyor track 5 and abut the sets 6. The rest walls 12, 13 are held in place each by two horizontal support bolts 14, 15, 16 in bearings 17, 18 mounted in the frame 3. At least one of the rest walls 12, 13 is displaceable transversely to the other in order to change the spacing, and an electric motor may be used for such a drive.

The main components of the conveyor track 5 are a heating plate 19 stationary in the frame 3 and a cooling plate 20, also stationary, mounted subsequently as seen in the direction of advance. The cooling plate 20 is perforated. A radial blower 21 is mounted underneath said plate 20 and during operation moves air from below up and through the plate.

Support plates 22, 23, 24, 25 are mounted in front of the heating plate 19 and in front of the cooling plate 20 as seen in the direction of advance; they are located at the same level as the heating plate 19 and the cooling plate 20. In this manner a substantially closed and horizontal conveyor track 5 is achieved.

A revolving conveyor assembly 27 cooperates with the conveyor track 5. The revolving conveyor assembly 27 comprises two reversing rollers 28, 29 supported near the ends of the conveyor track 5 in the frame 3, their axes of rotation being transverse to the direction of advance. The reversing roller 29 shown in elevation in FIGS. 1 on the right is driven clockwise by an electric motor 30.

Figure 2:
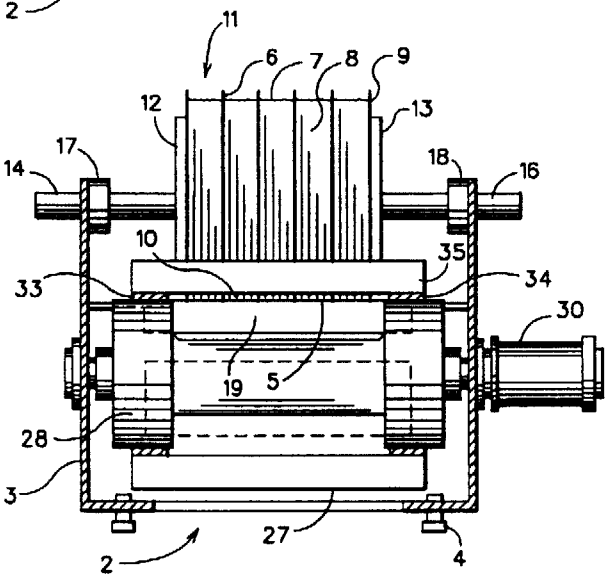
FIG. 2 is a cross-section of the binding apparatus of FIG. 1.

In the embodiment shown in FIGS. 1 and 2, two parallel edge belts 33, 34 are placed around the reversing rollers 28, 29, which run over the support plate 23, the heating, plate 19, the support plate 24, the cooling plate 20 and the support plate 25 and is supported there. The width between belts 33, 34 corresponds to the widest possible spacing between the rest walls 12, 13.

The conveyor belt consists of a heat-resistant material, and therefore it shall not be degraded by the heating plate 19. The volumes 7 are placed on the conveyor belt. This belt is so thin and therefore so low in heat capacity that the volumes 7 are adequately heated from the heating plate 19 and are cooled well enough by the cooling plate 20.

In the embodiment shown in FIGS. 1 and 2, two parallel edge belts 33, 34, which may alternatively be link belts or the like, revolve outside the insertion shaft 11. They are connected by drive strips 35 extending transversely to the direction of advance and mounted to the outsides of the edge belts 33, 34. The drive strips 35 are spaced apart a distance corresponding to the center-to-center spacing between the heating plate 19 and the cooling plate 20.

In this embodiment, the volumes 7 rest directly on the conveyor track 5, that is, they make direct contact through their spines 10 with the heating plate 19 and the cooling plate 20. During advance, the drive strips 35 move against the rear ends of the sets 6 and displace them over the heating plate 19 and the cooling plate 20 as well as over the support plates 23, 24, 25, 26.

The binding apparatus 2 operates as follows:

As a rule the binding apparatus 2 is turned ON. An electronic control unit not shown herein in further detail assures that the heating plate 19 be in the standby condition, ie, it is heated but not to the full operational temperature. The radial blower 21 is OFF.

Before a set 6 is put into the insertion shaft 11, the rest walls 12, 13 are moved apart as much as possible. Thereupon the set 6 is placed from above into the region of the heating plate 19 into the insertion shaft 11 in such a way that the spines 10 of the covers 9 come to rest at the bottom. A sensor, for instance a light barrier, detects the set 6 and turns ON the heating plate 19 to full operational power. At the same time the displaceable rest wall 12, 13 is moved toward the opposite rest wall until the set 6 rests against both sides of the rest walls 12, 13. Automation ensures that when there is contact between the rest walls 12, 13 and the set 6, the drive means are turned OFF.

After the heating plate 19 has reached a specified temperature for some length of time, a fact which is detected by a temperature sensor not shown herein in further detail, a switching timer is started. It is set in such a way that the heating plate 19 will be at full heating power until the hot-melt strip at the insides of the spines 10 is reliably plasticized and the edges of the sheets 8 resting on it can sink into it. Upon expiration of the predetermined time the revolving conveyor assembly 27 is started, that is, the electrical motor 3 is energized. Thereupon the set 6 is advanced until its full length is located above the cooling plate 20. Then the revolving conveyor assembly 27 is stopped again. A corresponding sensor may be provided for this purpose in the region of the cooling plate 20, said sensor being connected with the control unit and turning OFF the electric motor. This sensor also turns ON the radial blower 21 by means of the control unit, as a result of which the spines 10 are intensively cooled.

The region of the heating plate 19 in the insertion shaft 11 being again free, it may receive another set 6. If the control unit meantime switched the heating power back to standby operation, then the insertion of the set 6 shall again initiate full power. However provision also may be made that the heating remain at full power for some time even if the heating plate 19 is unoccupied, that is, that the standby operation shall be reverted to only after that time. Following an adequate time interval, the set 6 above the cooling plate 20 can be removed. Illustratively this may be announced by an optical or acoustic signal.

The control unit also contains a protective circuit preventing the revolving conveyor assembly 27 from being started if oil one hand a set 6 should still be above the cooling plate 20 and on the other hand the following set 6 should have been sufficiently heated by the heating plate 19 and the switching timer would attempt per se to drive the electric motor 30. In that event the switching timer merely switches the heating plate 19 to standby operation. The electric motor 30 in this case shall be driven only after the set 6 above the cooling plate 20 has been removed and the sensor present there so notifies the control circuit. In this manner the revolving conveyor assembly 27 is prevented from removing the set 6 located above the cooling plate 20 from the apparatus frame 3. Obviously such a protective circuit is not needed if the binding apparatus 1, 2 is followed by a stacking system with adequate stacking volume. Such stacking systems are known from other engineering fields.

The two rest walls 12, 13 are continuous in the illustrative embodiments shown herein. However it is feasible also to divide each with respect to the region of the heating plate 19 and the region of the cooling plate 20. In this manner the spacings between the rest walls 12, 13 can be adjusted independently from each other. As a result, sets 6 of much different widths can be processed in immediate sequence. A logic circuit may be provided for that purpose which ensures that during advance, the spacing of the rest walls in the region of the cooling plate 20 be automatically matched to the spacing of the rest walls 12, 13 in the region of the heating plate 19.

Moreover the binding apparatus 1, 2 may be modified in such a way that a shake plate be present between the heating plate 19 and the cooling plate 20—obviously following corresponding enlargement of the spacing between the heating plate 19 and the cooling plate 20. The spacing should be such that a full set 6 can be adequately received on the inserted shake plate. Such shake plates also are known from the U.S. Pat. No. 4,108,713. They ensure that the lower edges of the sheets 8 better sink into the plasticized hot-melt adhesive. The additional installation of the shake plate offers tire advantage that at least three sets 6 can be processed simultaneously inside the binding apparatus 1, 2. Corresponding control units assure that the shake plate shall be started the moment a sensor present therein detects a set 6.

I claim:

1. A binding apparatus for binding loose sheets into covers having a thermoplastic adhesive on the inside of their spine so as to form volumes, said apparatus comprising a frame provided with two mutually spaced supports forming an insertion shaft for the covers, the insertion shaft being equipped at is bottom with a heating system and with a cooling system, characterized in that the insertion shaft (11) extends toward one side of said apparatus, the cooling system (20) is received in said shaft, and a conveyor assembly (27) having a revolving drive (30) is operably associated with said apparatus for moving the covers (9) placed in said insertion shaft (11) from the heating system (9) to the cooling system (20).

2. Binding apparatus defined in claim 1, characterized in that the cooling system includes a cooling plate (20).

3. Binding apparatus defined in claim 2, characterized in that the cooling plate (20) is a shake plate with a vibration device.

4. Binding apparatus defined in claim 1, characterized in that a vibration device including a shake plate is operably disposed between the heating system (19) and the cooling system (20).

5. Binding apparatus defined in claim 2, characterized in that the shake system is a pivot device to pivot the shake plate about an axis parallel to the direction of advance.

6. Binding apparatus defined in claim 1, characterized in that the cooling system (20) comprises a cooling blower (21) with air-feed to the spines of the covers (9).

7. Binding apparatus defined in claim 4, characterized in that the cooling system comprises a cooling plate (20) with perforations to allow blowing air upwards through them.

8. Binding apparatus defined in claim 1, characterized in that the healing system comprises a heating plate (19) fitted with a heating element.

9. Binding apparatus defined in claim 1, characterized in that the heating system is an infrared radiator.

10. Binding apparatus defined in claim 1, characterized in that the conveyor assembly comprises a conveyor belt passing over the heating and cooling systems (19, 20).

11. Binding apparatus defined in claim 10, characterized in that the conveyor belt includes clearances.

12. Binding apparatus defined in claim 11, characterized in that the conveyor belt is a link-belt.

13. Binding apparatus defined in claim 10, characterized in that in the insertion shaft (11), the conveyor belt rests on a continuous support surface (23, 24, 25).

14. Binding apparatus defined in claim 1, characterized in that the conveyor assembly (27) consists of two parallel, evolving edge belts (33, 34) with drive means (35) for the covers (9) and in that a continuous support surface (23, 24, 25) is present in the insertion shaft (11).

15. Binding apparatus defined in claim 1, characterized in that a control unit to control the power to the revolving drive (30) and a correlated switching timer are provided to turn ON the revolving drive (30) once the inserted covers (9) have been exposed a specified time to the heating system (19), namely until the covers (9) are located in the region of the cooling system (20) or of any shake plate.

16. Binding apparatus defined in claim 15, characterized in that the control unit comprises a circuit such that the heating system (19) is turned OFF, or the power is reduced, when the revolving drive (30) is turned ON.

17. Binding apparatus defined in claim 15, characterized in that the control unit comprises a sensor to detect the covers (9) in the region of the heating system (19), said sensor turning the heating system ON or raising it to full power when a cover (9) is inserted.

18. Binding apparatus defined in claim 15, characterized in that a temperature sensor is provided to sense the temperature of the heating system (19) and is connected in such a way by an electronic circuit to the switching timer that it turns ON this switching timer only when the heating system (19) evinces a specified temperature.

19. Binding apparatus defined in claim 15, characterized in that the control unit comprises a sensor to detect the covers (9) in the region of the cooling system (20) and by means of which the revolving drive is shut down as long as the there are covers (9) in the last segment of the cooling system (20).

20. Binding apparatus defined in claim 19, characterized in that the control unit includes an alarm which shall be actuated once the covers have been a specified time in the last segment of the cooling system.

21. Binding apparatus defined in claim 19, characterized in that the control unit turns ON the cooling blower (21) and/or the shake system as soon as the sensor detects a cover (9).

22. Binding apparatus defined in claim 15, characterized in that the heating system (19), the cooling system (20) and any shake system comprise separate supports with drives for independent spacing changes, a spacing control drive being provided which so controls the drives that upon starting the revolving drive (30), the spacing of the next support as seen in the direction of advance shall be matched to that spacing which was previously assumed by the immediately preceding support.

23. Binding apparatus defined in claim 1, characterized in that the insertion shaft (11) and the conveyor assembly (27) are extended at one of the free side of the heating system and the cooling system (20).

24. Binding apparatus defined in claim 1, characterized in that a stacking system adjoins the cooling system.

* * * * *

UNITED STATES PATENT AND TRADEMARK OFFICE

CERTIFICATE OF CORRECTION

PATENT NO. : 5,454,680

DATED : October 3, 1995

INVENTOR(S) : Peter Lazar

It is certified that error appears in the above-indentified patent and that said Letters Patent is hereby corrected as shown below:

On the title page, item [56], add the following information:

U.S. PATENT DOCUMENTS

| | | | |
|---|---|---|---|
| --3,126,562 | 3/1964 | Carstens | 11/4 |
| 3,166,463 | 1/1965 | Klostermann | 156/477 |
| 3,863,596 | 2/1975 | Anderson | 118/5 |
| 4,080,678 | 3/1978 | Müller | 11/1 AD |
| 4,863,332 | 9/1989 | Wilholm et al | 412/37-- |

FOREIGN PATENT DOCUMENTS

| | | |
|---|---|---|
| --1,052,938 | 12/1966 | British Patent Office-- |

Signed and Sealed this

Nineteenth Day of March, 1996

Bruce Lehman

*Attest:*

BRUCE LEHMAN

*Attesting Officer*

*Commissioner of Patents and Trademarks*